US009884414B2

(12) United States Patent
DeVecchis

(10) Patent No.: US 9,884,414 B2
(45) Date of Patent: Feb. 6, 2018

(54) RESERVOIR CAP SOCKET

(71) Applicant: Snap-on Incorporated, Kenosha, WI (US)

(72) Inventor: Marco DeVecchis, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 249 days.

(21) Appl. No.: 14/833,504

(22) Filed: Aug. 24, 2015

(65) Prior Publication Data

US 2017/0057065 A1 Mar. 2, 2017

(51) Int. Cl.
*B25B 27/00* (2006.01)
*B67B 7/18* (2006.01)

(52) U.S. Cl.
CPC ..... *B25B 27/0042* (2013.01); *B67B 7/18* (2013.01)

(58) Field of Classification Search
CPC ... B25B 27/0042; B25B 13/06; B25B 13/065; B25B 13/48; B25B 13/5091
See application file for complete search history.

(56) References Cited

U.S. PATENT DOCUMENTS 107,255 A * 9/1870 Harris ..... B25B 13/48 7/138
3,007,357 A 11/1961 Nalley
3,048,067 A 8/1962 Miles et al.
3,121,355 A 2/1964 Morel et al.
3,186,263 A 6/1965 Grote
3,618,428 A 11/1971 Phipps
3,638,515 A * 2/1972 Lentz ..... B25B 27/0042 81/176.2
4,357,845 A 11/1982 Cornia
4,836,065 A 6/1989 Setliff
4,846,025 A 7/1989 Keller et al.
5,003,845 A 4/1991 Roy et al.
5,161,436 A 11/1992 Stevenson
5,896,785 A 4/1999 Shaw et al.
6,294,719 B1 9/2001 Palecki
6,401,575 B1 6/2002 Shively et al.
6,715,384 B1 * 4/2004 Kozak ..... B25B 13/06 81/124.2
6,779,424 B2 * 8/2004 Schmidt ..... B25B 13/48 81/124.2
6,962,098 B2 * 11/2005 Eggert ..... B25B 13/06 81/121.1

(Continued)

FOREIGN PATENT DOCUMENTS

CN 201495565 U 6/2010
JP 2004276156 A 10/2004
WO 9513243 A 5/1995

OTHER PUBLICATIONS

Lisle Invention Disclosure, Mox—"A cap that will fit the oil filter cap", pp. 2, Feb. 10, 2008.

(Continued)

*Primary Examiner* — David B Thomas
(74) *Attorney, Agent, or Firm* — Seyfarth Shaw LLP

(57) ABSTRACT

A socket for gripping a reservoir cap and rotating the reservoir cap for easy removal. The socket can grip a variety of differently shaped reservoir caps, for example, reservoir caps associated with reservoirs of different automobiles. The socket can be made of nylon and can be glass-reinforced so as to be lightweight and chemically resistant.

20 Claims, 5 Drawing Sheets

(56) References Cited

U.S. PATENT DOCUMENTS

| | | | | |
|---|---|---|---|---|
| 7,243,579 | B2 | 7/2007 | Hennessey | |
| D570,168 | S | 6/2008 | James | |
| 7,802,499 | B2 * | 9/2010 | Stephens | B25B 13/065 81/124.2 |
| 8,083,276 | B2 * | 12/2011 | Schopp | B25B 9/00 29/242 |
| 8,220,135 | B2 * | 7/2012 | Vogel | B25B 13/5091 279/144 |
| 8,303,813 | B2 | 11/2012 | Coleman | |
| 8,627,561 | B2 * | 1/2014 | Ovenshire | B25B 27/02 29/278 |
| 8,826,780 | B1 | 9/2014 | Alho | |
| 2003/0097909 | A1 | 5/2003 | Pote | |
| 2004/0255727 | A1 * | 12/2004 | Kovach | B25B 13/02 81/176.15 |
| 2006/0243102 | A1 * | 11/2006 | Vines | B25B 13/06 81/124.2 |
| 2008/0011128 | A1 * | 1/2008 | Stephens | B25B 13/065 81/124.2 |
| 2011/0000024 | A1 * | 1/2011 | Johnson | B25B 15/008 7/118 |
| 2011/0017991 | A1 | 1/2011 | Tanimoto et al. | |
| 2011/0259158 | A1 | 10/2011 | Richardson | |
| 2011/0283500 | A1 | 11/2011 | Alho | |
| 2012/0198970 | A1 | 8/2012 | Robidoux | |
| 2012/0234141 | A1 * | 9/2012 | Kang | B25B 13/48 81/124.4 |
| 2013/0014615 | A1 * | 1/2013 | Peterson | B25B 13/48 81/119 |

OTHER PUBLICATIONS

Lisle Invention Disclosure, Goodwill—"Removal Tool for GM radiator cap removal assist tool", pp. 1, Nov. 18, 2008.
http://buy1.snapon.com/catalog/item.asp?P65=&tool=all&item_ID=78512&group_ID=204, p. 1, Apr. 8, 2008.
Taiwan Patent Office, Office Action, 6 pages.
Australian Government Patent Examination Report No. 1, dated Sep. 9, 2016; 5 pages.
UK Combined Search and Examination Report, dated Nov. 8, 2016; 8 pages.
Taiwan Office Action for Application No. 105126858 dated Jun. 8, 2017, 5 pages.

* cited by examiner

RESERVOIR CAP SOCKET

TECHNICAL FIELD OF THE INVENTION

The present invention relates generally to a socket. More particularly, the present invention relates to a universal socket for reservoir caps, such as oil fill or radiator caps of automobiles.

BACKGROUND OF THE INVENTION

Reservoir caps are prevalent in many applications, for example, automobiles. Automobiles include reservoir caps on oil fill holes and radiators, to name a few examples. These reservoir caps removably seal the reservoir from outside debris and keep the internal contents of the reservoir from spilling outside of the reservoir. For example, the reservoir cap may include threads that engage corresponding threads in the reservoir to couple with the reservoir.

Reservoir caps are typically circular-shaped and have a handle extending across a diameter of the reservoir cap so that the user can grip the reservoir cap and rotate it to threadably couple the reservoir cap to the reservoir. However, the handle and reservoir cap geometry is different for different vehicle makes. Also, certain reservoir caps can become difficult to rotate or remove, and can benefit from a tool that grips the reservoir cap for removal.

SUMMARY OF THE INVENTION

The present invention broadly comprises a socket for gripping a reservoir cap and rotating the reservoir cap for easy removal. The socket can have geometry that allows the socket to grip a variety of differently shaped reservoir caps, for example, reservoir caps associated with reservoirs of different automobiles. The socket can be reinforced with glass fibers and be made of a nylon base so as to be lightweight and chemically resistant.

In an embodiment, the present invention includes a socket including a base extending from a first side and a working section extending from the base to a second side opposite the first side. The working section has a perimeter proximate the second side with a first gripping structure adapted to grip a first type of work piece, and a second gripping structure adapted to grip a second type of work piece different than the first type of work piece.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
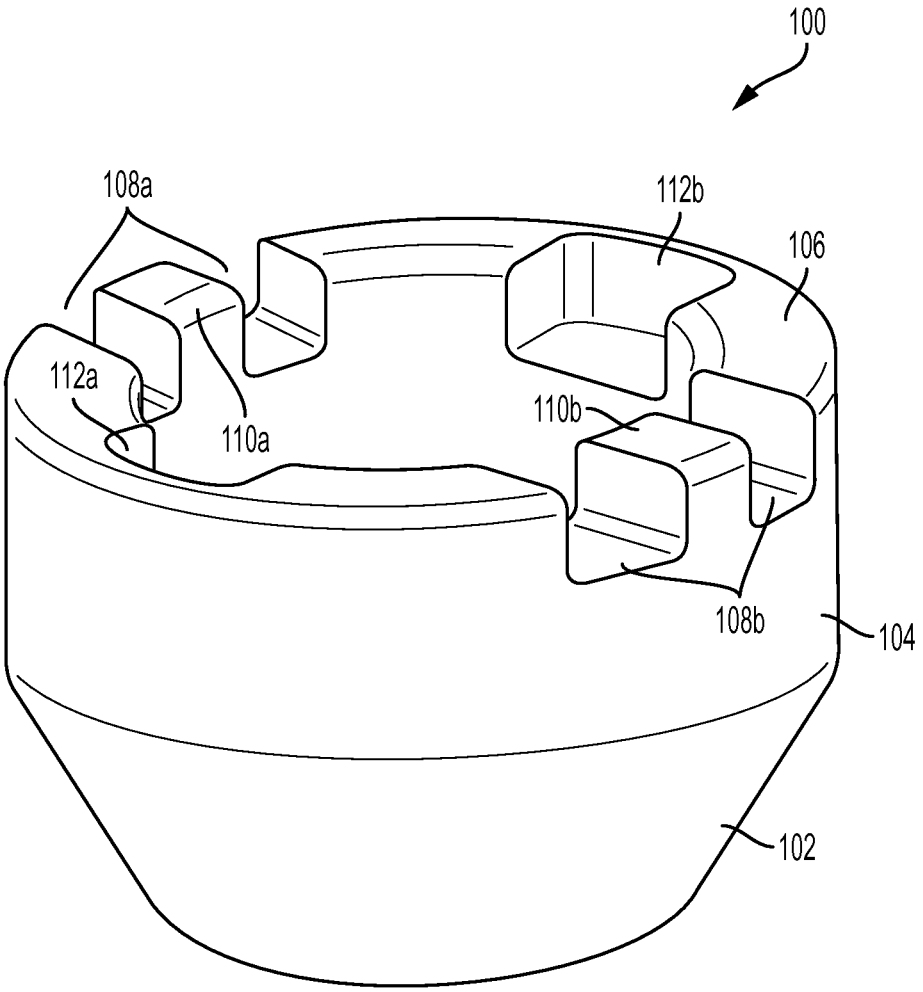
FIG. 1 is a side perspective view of a socket according to an embodiment of the present invention.
Figure 2:
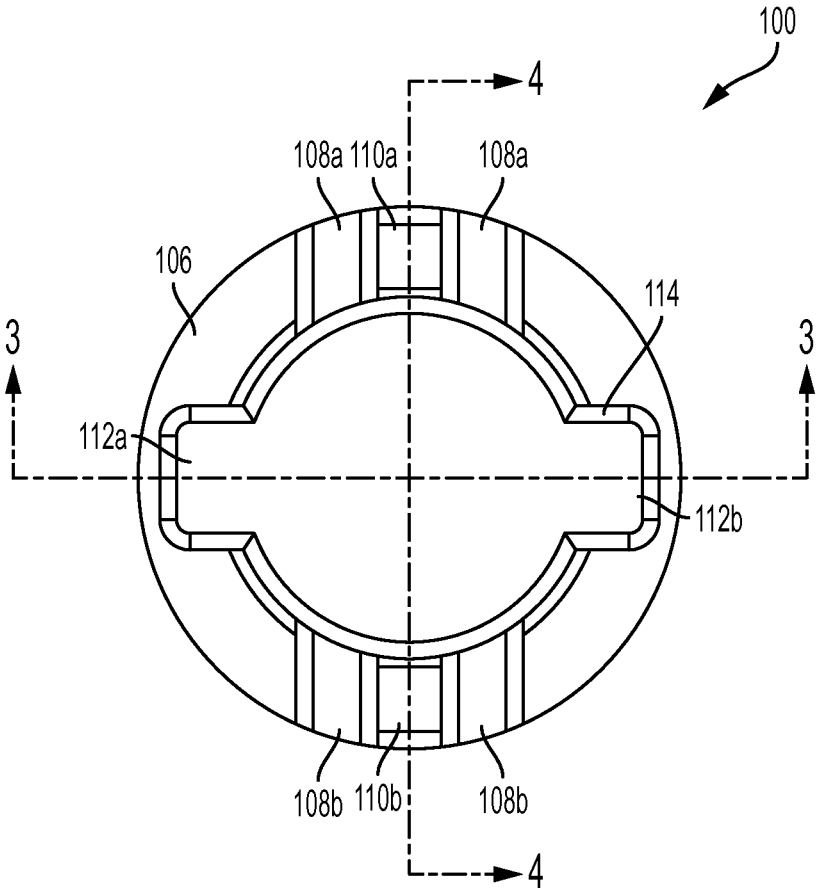
FIG. 2 is a top plan view of the socket illustrated in FIG. 1 according to an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a socket for gripping and rotating a reservoir cap for easy removal. The socket can grip a variety of differently shaped reservoir caps, for example, reservoir caps associated with reservoirs of different automobiles. The socket can be made of nylon and can be glass-reinforced to be lightweight and chemically resistant.

Referring to FIGS. 1-4, a socket 100 can include a base 102 coupled to a working section 104. The base 102 can extend from a first side of the socket 100 and the working section 104 can extend to a second side of the socket 100 opposite the first side. Surrounding the working section 104 can be a perimeter 106 upon which the socket 100 can include geometry for gripping a work piece, such as a reservoir cap. For example, the perimeter 106 can include gaps 108*a,b* separated by protrusions 110*a,b* to grip one or more types of work pieces, and indents 112*a,b* to grip other types of work pieces. The socket 100 can also include a ledge 114 located on a radially internal portion of the socket 100 to receive the work piece and facilitate its entry into the socket 100.

As shown, the base 102 can be frustoconical. However, any shape base 102 can be implemented without departing from the spirit and scope of the present invention. Similarly, the perimeter 106 is shown as circular, but can be any shape.

The working section 104 is the part of the socket 100 that interacts with work pieces, such as reservoir caps. The working section 104 can include geometry disposed along the perimeter 106 of the socket 100 to engage various different types of work pieces with a single socket 100. For example, the working section 104 includes gaps 108*a,b* separated by protrusions 110*a,b* to grip a particular type of reservoir cap. As shown, a first set of gaps 108*a* and a first protrusion 110*a* can be located across the socket 100 from a second set of gaps 108*b* and a second protrusion 110*b*. The gaps 108*a,b* can extend over a work piece during use and, when the socket is rotated 100, the protrusions 110*a,b* can contact the work piece and rotate it. Similarly, a first indent 112*a* can be located across the socket 100 from a second indent 112*b*, where the side walls of the indent contact the work piece when the socket is rotated. According to this geometry, the socket 100 can grip various sizes and shapes of work pieces (for example, in a work shop servicing multiple, different types of automobiles) with a single socket 100, rather than requiring multiple sockets to perform the same function. The gaps 108*a,b* and protrusions 110*a,b* can collectively be referred to as a "first gripping structure," while the indents 112*a,b* can collectively be referred to as a "second gripping structure."

The gaps 108*a,b* and protrusions 110*a,b* can be disposed perpendicular to the indents 112*a,b*, as shown, so multiple types of work pieces can be gripped by the socket 100. Alternately, the gaps 108*a,b* and protrusions 110*a,b* c an be disposed at a different angle relative to the indents 112*a,b*, for example 45 degrees, and other gripping structures can be implemented to grip even more work pieces with a single socket 100. Any other orientation of gripping structures can be implemented without departing from the spirit and scope of the present invention.

The ledge 114 allows easy insertion of the work piece into the socket 100. For example, the ledge 114 can be chamfered, rounded, or any other geometry that reduces the sharpness of the radially-internal edge of the working section 104.

Figure 3:
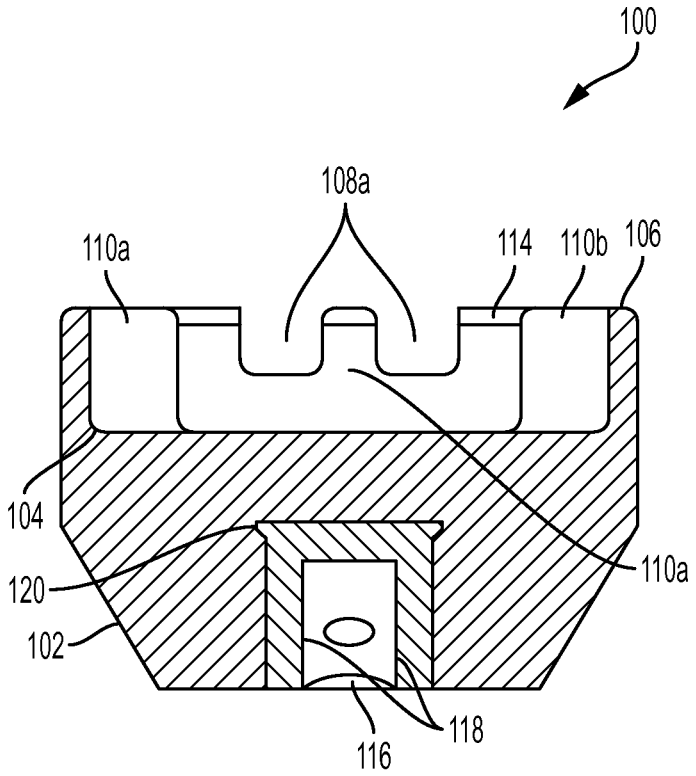
FIG. 3 is a side sectional view of a socket as taken along line 3-3 of FIG. 2 according to an embodiment of the present invention.
Figure 4:
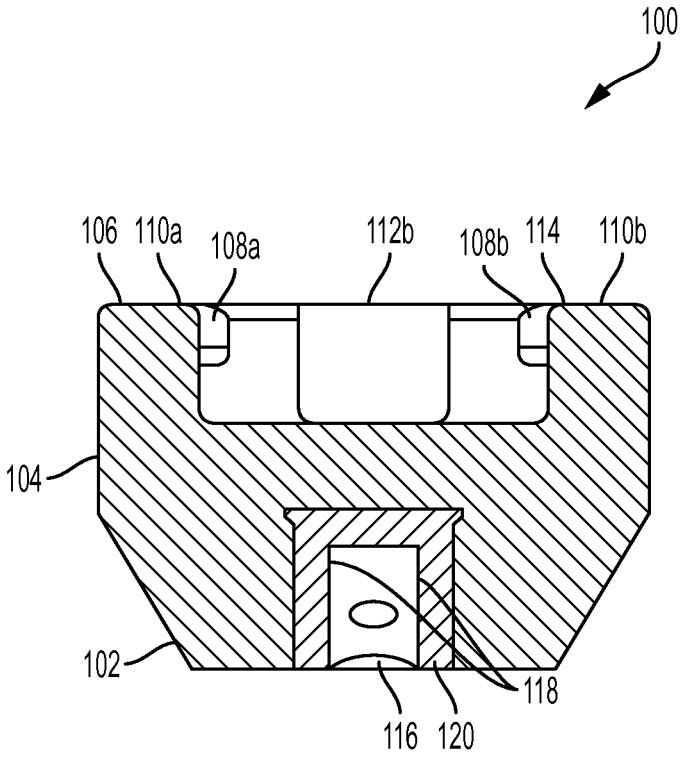
FIG. 4 is a side sectional view of a socket as taken along line 4-4 of FIG. 2 according to an embodiment of the present invention.

Referring to FIGS. 3 and 4, the socket 100 can include a cavity 116 with indents 118 in a receiving portion 120. The combination of the cavity 116, indents 118, and receiving portion 120 allow a drive tool, such as a ratchet wrench, to be used to drive the socket 100 in a rotatable manner. For example, the drive tool can include a drive lug with ball detents that are spring loaded to push into the drive lug when the drive lug is inserted into the cavity 116, and push out of the drive lug to engage the indents 118 of the socket 100 when positioned proximate the indents 118. In this manner, the drive tool can couple to the socket 100 and remove or tighten the work piece.

In an embodiment, the cavity 116 can be formed within a receiving portion 120 that is a separate component from the base 102 and working section 104. For example, the receiving portion 120 can be made of a different material than the base 102 and working section 104, so that the receiving portion 120 can better receive the drive lug of the drive tool and be rotated by the drive tool. In an embodiment, the receiving portion 120 is made of a material that is stiffer than the material of the base 102 and working section 104. For example, the receiving section can be made of steel or other suitable metal, and the base 102 and working section 104 can be made of glass-reinforced nylon. In this manner, the receiving portion 120 can be stiffer to better receive the drive lug, and the base 102 and working section 104 can be softer to not harm the work piece. At the same time, the base 102 and working section 104 can be durable, chemical resistant, and light weight, compared to conventional sockets 100 made entirely of steel.

Figure 5:
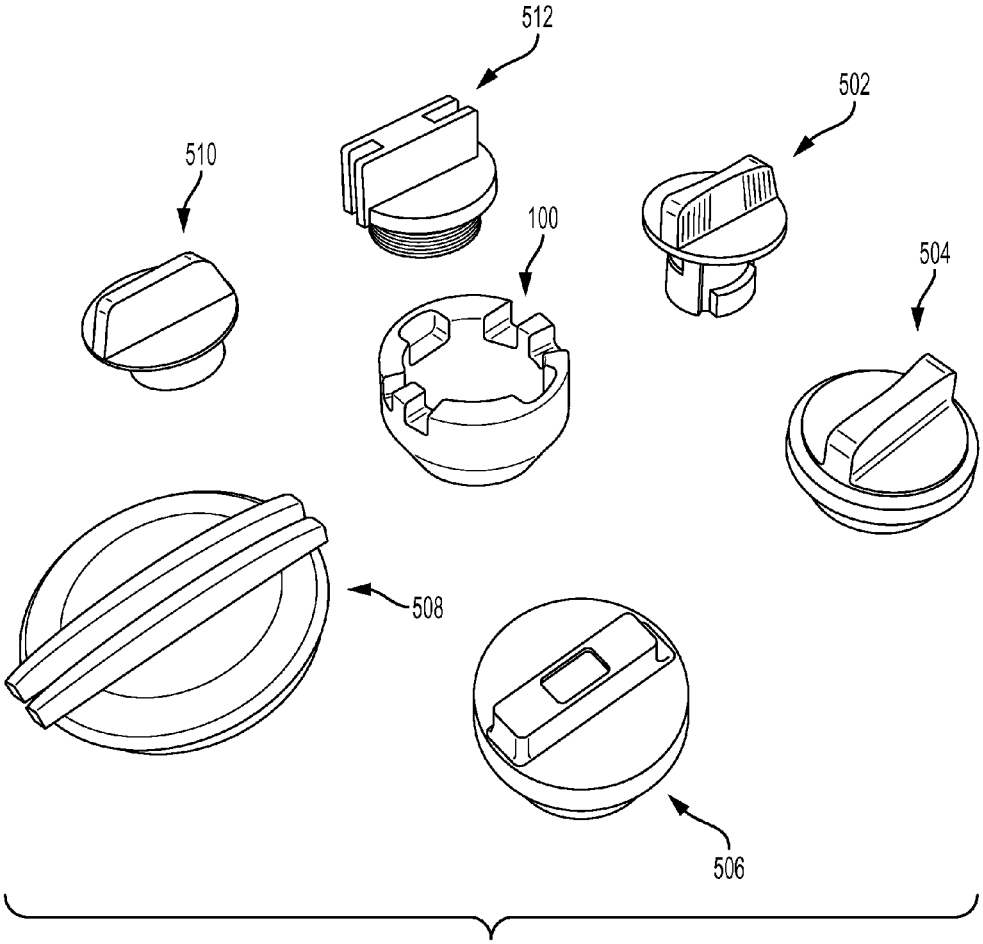
FIG. 5 is a top perspective view of a socket alongside various reservoir cap work pieces according to embodiments of the present invention.

As discussed herein, the present invention can typically be used for gripping and rotating reservoir caps. For example, referring to FIG. 5, the socket 100 can be used to grip first 502, second 504, third 506, fourth 508, fifth 510, and sixth 512 reservoir caps commonly associated with Honda®, Toyota®, Volkswagon®, Audi®, Chevrolet®, Jeep® and Ford® automobiles. However, the work piece need not be a reservoir cap, and the present invention can be used to grip and remove, or engage in any way, any work piece.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A socket having opposing first and second ends adapted to engage first and second work pieces comprising:
- a base extending from the first end;
- a working section extending from the base towards the second end opposite the first end, the working section having a perimeter proximate the second end,
- wherein the perimeter includes:
  - a first gripping structure adapted to grip the first work piece when the socket is engaged with the first work piece, wherein the first gripping structure includes a pair of first gaps separated by a first protrusion, and a pair of second gaps separated by a second protrusion, wherein the first gaps and first protrusion respectively diametrically oppose the second gaps and second protrusion; and
  - a second gripping structure adapted to grip the second work piece when the socket is engaged with the second work piece, wherein the second gripping structure includes diametrically opposing first and second indents.

2. The socket of claim 1, wherein the base and working section are composed of a reinforced glass nylon material.

3. The socket of claim 1, wherein the first gripping structure is displaced approximately 90 degrees relative to the second gripping structure.

4. The socket of claim 1, wherein the base is frustoconical.

5. The socket of claim 1, wherein the perimeter is circular.

6. The socket of claim 1, further comprising a receiving portion defining a cavity, the cavity adapted to receive a drive lug for driving the socket.

7. The socket of claim 6, wherein the receiving portion includes an indent adapted to engage a ball detent of the drive lug to detainably couple the drive lug to the receiving portion.

8. The socket of claim 6, wherein the base and working section are composed of a reinforced glass nylon material, and the receiving portion is composed of a metallic material.

9. The socket of claim 6, wherein the working section is composed of a first material and the receiving portion is composed of a second material stiffer than the first material.

10. A socket having opposing first and second ends adapted to engage first and second work pieces comprising:
- a base extending from the first end;
- a working section extending from the base towards the second end opposite the first end, the working section having a perimeter proximate the second end,
- wherein the perimeter includes:
  - a first gripping structure adapted to grip the first work piece when the socket is engaged with the first work piece, wherein the first gripping structure includes a gap and a protrusion disposed on the perimeter; and
  - a second gripping structure adapted to grip the second work piece when the socket is engaged with the second work piece.

11. The socket of claim 10, wherein the base and working section are composed of a reinforced glass nylon material.

12. The socket of claim 10, wherein the first gripping structure is displaced approximately 90 degrees relative to the second gripping structure.

13. The socket of claim 10, wherein the second gripping structure includes an indent disposed on the perimeter.

14. The socket of claim 10, wherein the second gripping structure includes a first indent disposed opposite a second indent along the perimeter.

15. The socket of claim 10, wherein the base is frusto-conical.

16. The socket of claim 10, wherein the perimeter is circular.

17. The socket of claim 10, further comprising a receiving portion defining a cavity, the cavity adapted to receive a drive lug for driving the socket.

18. The socket of claim 17, wherein the receiving portion includes an indent adapted to receive a ball detent of the drive lug to couple the drive lug to the receiving portion.

19. The socket of claim 17, wherein the base and working section are composed of a reinforced glass nylon material, and the receiving portion is composed of a metallic material.

20. The socket of claim 17, wherein the working section is composed of a first material and the receiving portion is composed of a second material stiffer than the first material.

* * * * *